United States Patent [19]

Boyd

[11] Patent Number: 4,864,621

[45] Date of Patent: Sep. 5, 1989

[54] METHOD OF SPEECH CODING

[75] Inventor: Ivan Boyd, Ipswich, England

[73] Assignee: British Telecommunications public limited company, United Kingdom

[21] Appl. No.: 187,533

[22] PCT Filed: Sep. 3, 1987

[86] PCT No.: PCT/GB87/00612

§ 371 Date: May 3, 1988

§ 102(e) Date: May 3, 1988

[87] PCT Pub. No.: WO88/02165

PCT Pub. Date: Mar. 24, 1988

[30] Foreign Application Priority Data

Sep. 11, 1986 [GB] United Kingdom ..... 8621932

[51] Int. Cl.[4] ..... G10L 5/00

[52] U.S. Cl. ..... 381/38; 381/49; 381/51

[58] Field of Search ..... 381/37–53; 364/513.5

[56] References Cited

U.S. PATENT DOCUMENTS 4,709,390 11/1987 Atal et al. ..... 381/51

FOREIGN PATENT DOCUMENTS 0137532 4/1985 European Pat. Off. .

*Primary Examiner*—Emanuel S. Kemeny
*Attorney, Agent, or Firm*—Nixon & Vanderhye

[57] ABSTRACT

A multipulse excitation signal estimate is followed by chronological adjustment.

8 Claims, 1 Drawing Sheet

METHOD OF SPEECH CODING

Figure 1:
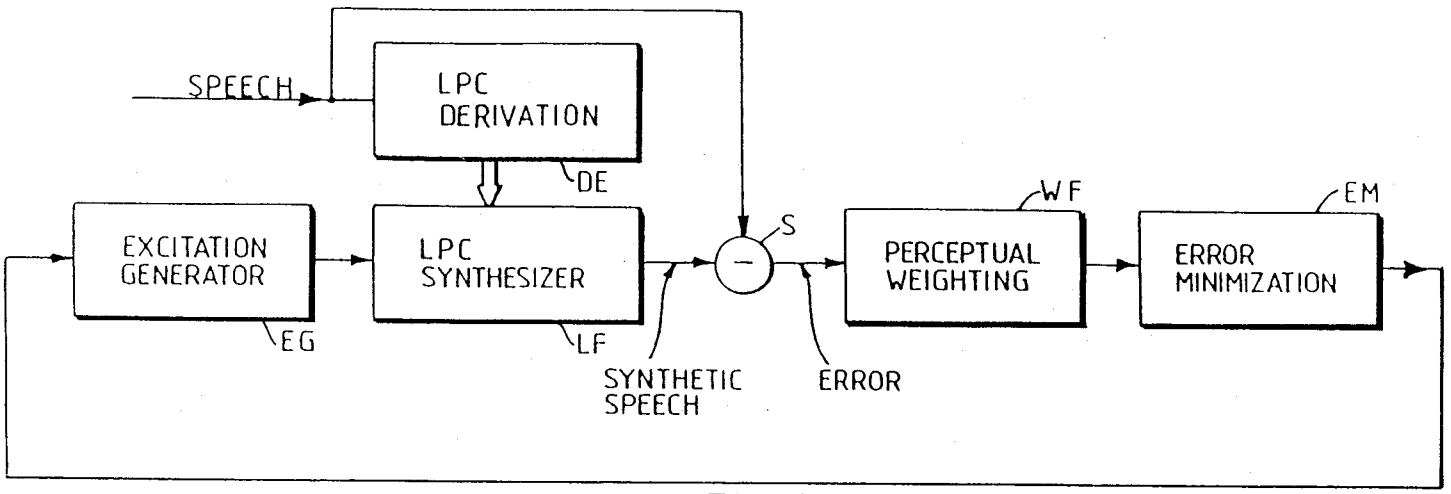
Fig.1 (PRIOR ART)

This invention is concerned with speech coding, and more particularly to systems in which a speech signal can be generated by feeding the output of an excitation source through a synthesis filter. The coding problem then becomes one of generating, from input speech, the necessary excitation and filter parameters. LPC (linear predictive coding) parameters for the filter can be derived using well-established techniques, and the present invention is concerned with the excitation source.

Systems in which a voiced/unvoiced decision on the input speech is made to switch between a noise source and a repetitive pulse source tend to give the speech output an unnatural quality, and it has been proposed to employ a single "multipulse" excitation source in which a sequence of pulses is generated, no prior assumptions being made as to the nature of the sequence. It is found that, with this method, only a few pulses (say 8 in a 10 ms frame) are sufficient for obtaining reasonable results. See B S Atal and J R Remde: "A New Model of LPC Excitation for producing Natural-sounding Speech at Low Bit Rates", Proc. IEEE ICASSP, Paris, pp. 614, 1982.

Coding methods of this type offer considerable potential for low bit rate transmission—eg 9.6 to 4.8K bit/s.

The coder proposed by Atal and Remde operates in a "trial and error feedback loop" mode in an attempt to define an optimum excitation sequence which, when used as an input to an LPC synthesis filter, minimizes a weighted error function over a frame of speech. However, the unsolved problem of selecting an optimum excitation sequence is at present the main reason for the enormous complexity of the coder which limits its real time operation.

The excitation signal in multipulse LPC is approximated by a sequence of pulses located at non-uniformly spaced time intervals. It is the task of the analysis by synthesis process to define the optimum locations and amplitudes of the excitation pulses.

In operation, the input speech signal is divided into frames of samples, and a conventional analysis is performed to define the filter coefficients for each frame. It is then necessary to derive a suitable multipulse excitation sequence for each frame. The algorithm proposed by Atal and Remde forms a multipulse sequence which, when used to excite the LPC synthesis filter, minimises (that is, within the constraints imposed by the algorithm) a mean-squared weighted error derived from the difference between the synthesised and original speech. This is illustrated schematically in FIG. 1. Input speech is supplied to a unit DE which derives LPC filter coefficients. These are fed to determine the response of a local filter or synthesiser LF whose input is supplied with the output of a multipulse excitation generator EG. Synthetic speech at the output of the filter is supplied to a subtractor S to form the difference between the synthetic and input speech. The difference or error signal is fed via a perceptual weighting filter WF to error minimisation stage EM which controls the excitation generator EG. The positions and amplitudes of the excitation pulses are encoded and transmitted together with the digitized values of the LPC filter coefficients. At the receiver, given the decoded values of the multipulse excitation and the prediction coefficients, the speech signal is recovered at the output of the LPC synthesis filter.

In FIG. 1 it is assumed that a frame consists of n speech samples, the input speech samples being $s_o \ldots s_{n-l}$ and the synthesised samples $so' \cdots s_{n-l}'$, which can be regarded as vectors $\bar{s}$, $\bar{s}'$. The excitation consists of pulses of amplitude $a_m$ which are, it is assumed, permitted to occur at any of the n possible time instants within the frame, but there are only a limited number of them (say k). Thus the excitation can be expressed as an n-dimensional vector $\bar{a}$ with components $a_o \ldots a_{n-l}$, but only k of them are non-zero. The objective is to find the 2k unknowns (k amplitudes, k pulse positions) which minimise the error:

$$\bar{e}^2=(\bar{s}-\bar{s}')^2 \qquad (1)$$

—ignoring the perceptual weighting, which serves simply to filter the error signal such that, in the final result, the residual error is concentrated in those part of the speech band where it is least obtrusive.

The amount of computation required to do this is enormous and the procedure proposed by Atal and Remde was as follows:

(1) Find the amplitude and position of one pulse, alone, to give a minimum error.

(2) Find the amplitude and position of a second pulse which, in combination with this first pulse, give a minimum error; the positions and amplitudes of the pulse(s) previously found are fixed during this stage.

(3) Repeat for further pulses.

This procedure could be further refined by finally reoptimising all the pulse amplitudes; or the amplitudes may be reoptimised prior to derivation of each new pulse.

It will be apparent that in these procedures the results are not optimum, inter alia because the positions of all but the kth pulse are derived without regard to the positions or values of the later pulses: the contribution of each excitation pulse to the energy of the synthesised signal is influenced by the choice of the other pulses.

Gouvianakis and Xydeas proposed a modified approach in which the derivation of an estimate of the positions and amplitudes of the pulses is followed by an iterative adjustment process in which individual pulses are selected and their positions and amplitudes reassessed. This is described in their U.S. patent application No. 846854 dated 1 Apr. 1986, and UK patent application No. 8608031.

According to the present invention there is provided a method of speech coding in which an input speech signal is compared with the response of a synthesis filter to an excitation source, to obtain an error signal; the excitation source consisting of a plurality of pulses within a time frame corresponding to a larger plurality of speech samples, the amplitudes and timing of the pulses being controlled so as to reduce the error signal; in which control of the pulse amplitude and timing comprises the steps of:

(1) deriving an estimate of the positions and amplitudes of the pulses, and (2) carrying out an adjustment process in which each pulse in turn is examined in chronological order commencing with the earliest pulse of the frame and the position and amplitude thereof adjusted so as to reduce the mean error during that interval in the response of the filter to the excitation which corresponds to the interval between the respective pulse and the following pulse.

The method now to be proposed thus involves readjustment of an initial estimate. The initial estimate may in principle be made by any of the methods previously proposed, but a modified adjustment step is employed.

The invention also extends to a speech coder comprising:

means for deriving, from an input speech signal, parameters of a synthesis filter;

means for generating a coded representation of an excitation consisting of a plurality of pulses within a time frame corresponding to a larger plurality of speech samples being arranged in operation to select the amplitudes and timing of the pulses so as to reduce the difference between the input speech signal and the reponse of the filter to the excitation by:

(1) deriving an estimate of the positions and amplitudes of the pulses, and (2) carrying out an adjustment process in which each pulse in turn is examined in chronological order commencing with the earliest pulse of the frame and the position and amplitude thereof adjusted so as to reduce the mean error during that interval in the response of the filter to the excitation which corresponds to the interval between the respective pulse and the following pulse.

Other, optional features of the invention are defined in the subclaims.

Figure 2:
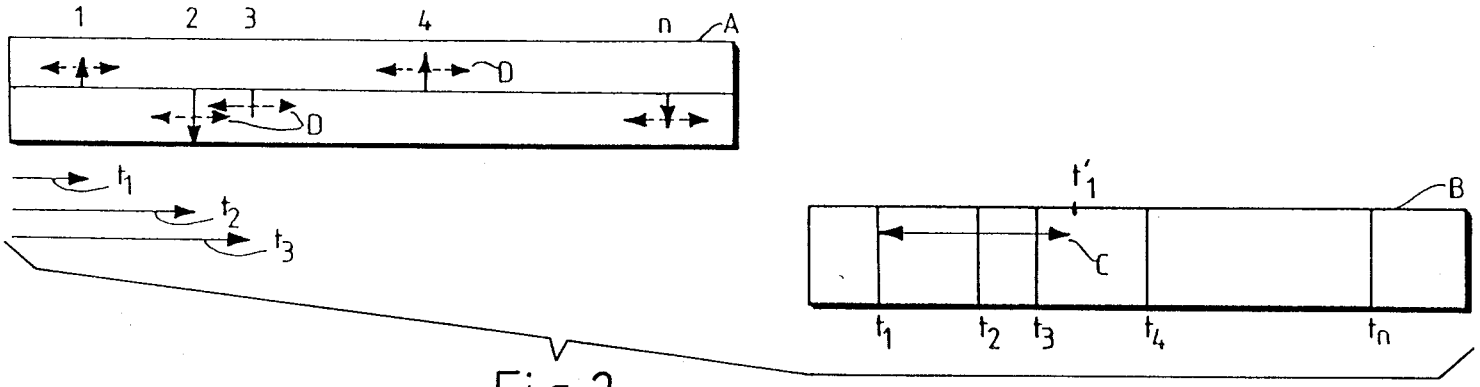

Some embodiments of the invention will now be described with reference to the accompanying drawing in which:

FIG. 1 is a block diagram of a known speech coder, also employed in the described embodiment of the invention; and FIG. 2 is a timing diagram illustrating the operation.

Consider the frame A illustrated in FIG. 2 where the pulse positions and amplitudes derived as the initial estimate are represented by solid arrows 1, 2, 3, n. (Pulse 1 being the earliest occuring) at times $t_1$, $t_2$ etc from the start of the frame, and also the corresponding frame B output from the filter. The output frame is defined as starting at the first sample in the output signal which will contain a contribution from a pulse at $t=0$ in the input frame, if such a pulse is present. Thus the output sample at time $t_3$ from the start of the output frame is the first output sample to contain a contribution from pulse 3 of the input frame.

The Gouvianakis/Xydeas procedure involves considering each pulse in turn, starting with the one assessed as having the largest contribution to the total error, and substituting another pulse if this gives rise to a reduction in the weighted error, averaged over the whole frame. The present invention recognises that this is not ideal. Considering pulse 1, this has an effect on the output frame from $t_1$ to a later point $t_1'$, dependent on the filter delay. For a typical frame length of 32 samples and a 12 tap filter, the region of effect might be as shown by the horizontal arrow C. In the region $t_1$ to $t_2$, the output is the sum of the filter memory (ie. contributions from pulses of the previous frame) plus the influence of pulse 1.

The previous frame excitation is assumed to have been already fixed, so that the output between $t_1$ and $t_2$ is a function only of the position and amplitude of pulse 1. The period between $t_2$ and $t_3$ contains contributions from both pulse 1 and pulse 2; if, as previously proposed, both pulses are adjusted to minimise the error over the whole frame, then the result during this period benefits from both adjustments and is superior to that obtained for the $t_1-t_2$ period. This effect is even more marked for the next period $t_2-t_3$ and therefore the signal to noise ratio is relatively high at the end of the frame, but lower at the beginning of the frame.

In the case of the invention, the pulse adjustment procedure is applied to each pulse in chronological order, starting with pulse 1. The pulse amplitude and position are adjusted so as to minimise not the error over the frame, but the error over the period $t_1$ to $t_2$. Pulse 2 is adjusted to minimise the error over the period $t_2$ to $t_3$ (taking into account of course the change in the effect of pulse 1 over this period). This process is repeated for all the pulses in turn up to pulse n which is adjusted to reduce the error between $t_n$ and the end of the frame. Whilst the SNR in the later periods of the frame may be lower than previously, the gain in the earlier periods is more than sufficient to offset this, and tests have shown that improvements in the overall SNR of the order of 1.5 dB may be obtained.

In practice it is found preferable to limit the range of pulse position adjustment so that each pulse is permitted to move only a limited number of places (indicated by the dotted arrows D in FIG. 2) each side of the first selected position. These limits could be the same for every pulse, or could increase for later pulses in the frame.

The adjustment procedure described may, if desired be repeated, though this is not essential.

It will be observed that each step of the adjustment process requires evaluation of the error only over the inter-pulse interval and can therefore require less computation than prior proposals requiring evaluation over the whole frame (or, at least) the remainder of the frame following the pulse under consideration. Thus the complexity of calculation is reduced.

As in previous proposals, a perceptual weighting filter may be included in the error minimisation loop.

One possible embodiment of the method may be summarised as follows.

Initial Estimate (a) take a frame of input speech (b) subtract the LPC filter memory from it (c) take the cross-correlation of the resultant with the impulse response of the filter (d) square the resulting values and divide by the impulse response power of the filter (e) find the peak of the cross-correlation and insert in the pulse frame a pulse of corresponding position and amplitude (f) subtract from the previously obtained cross-correlation the response of the filter to this pulse (g) repeat (d), (e) and (f) until a desired number of pulses have been found adjustment (h) for the first (in time) pulse of the frame, measure the error—ie. the mean square difference between (i) the filter response to this pulse and (ii) the difference between the input speech and the filter memory—averaged over the interval between the pulse and the next pulse (i) for different positions of the first pulse about the original position (up to say, ±3 sample positions), derive the pulse amplitude to minimise the error, and the error (calculated as in (h))

(j) if an improvement is obtained, substitute the pulse position (and amplitude) giving the lowest error into the pulse frame (k) repeat (h) to (j) for successive pulses, in chronological sequence the error now being the mean square difference between (i) the filter response to the pulse under consideration and the preceding (adjusted) pulse(s) and (ii) the difference between the input speech and the filter memory, averaged over the interval between the pulse and the next pulse. For the last pulse, the error is averaged over the period from the pulse to the end of the frame.

Once the pulses have all been adjusted they can be quantised using well known methods. Alternatively however the quantisation can be incorporated into the adjustment process (thereby taking into account the effect on later pulses of the quantisation error in the earlier pulses). Such a process is outlined below.

1. derive an initial estimate by performing steps (a) to (g) above.
2. calculate the r.m.s. value of the pulses found.
3. adjust the first pulse by performing steps (h), (j) above.
4. normalise the new amplitude found by division by the r.m.s. value calculated in 2, and quantise the normalised pulse amplitude.
5. adjust the quantised amplitude to cancel any non-linearity of the quantisation and multiply by the r.m.s value to produce a denormalised amplitude.
6. repeat steps 3 to 5 for successive pulses, in chronological sequence, the filter response used in computing the error now being the response to the pulse under consideration and the preceding denormalised quantised adjusted pulse(s). Obviously step 5 is not needed for the last pulse since the amplitudes to be output are the quantised normalised values obtained in step 4.

We claim:

1. A method of speech coding in which an input speech signal is compared with the response of a synthesis filter to an excitation source, to obtain an error signal; the excitation source consisting of a plurality of pulses within a time frame corresponding to a larger plurality of speech samples, the amplitudes and timing of the pulses being controlled so as to reduce the error signal; in which control of the pulse amplitude and timing comprises the steps of:

(1) deriving an estimate of the positions and amplitudes of the pulses, and (2) carrying out an adjustment process in which each pulse in turn is examined in chronological order commencing with the earliest pulse of the frame and the position and amplitude thereof adjusted so as to reduce the mean error during that interval in the response of the filter to the excitation which corresponds to the interval between the respective pulse and the following pulse.

2. A method according to claim 1 in which the adjustment process is subject to the limitation that any change in pulse position shall not exceed a pedetermined amount.

3. A method according to claim 1 or 2 in which the adjustment process is repeated.

4. A method according to claim 1 or 2 including, in the, or the last, adjustment process applied to a time frame, quantising the adjusted amplitude values, in which, in each pulse adjustment other than the first of a time frame, the excitation used to obtain the mean error to be reduced is derived using the quantised value(s) of the preceding pulses.

5. A speech coder comprising:

means for deriving, from an input speech signal, parameters of a synthesis filter;

means for generating a coded representation of an excitation consisting of a plurality of pulses within a time frame corresponding to a larger plurality of speech samples, being arranged in operation to select the amplitudes and timing of the pulses so as to reduce the difference between the input speech signal and the reponse of the filter to the excitation by:

(1) deriving an estimate of the positions and amplitudes of the pulses, and (2) carrying out an adjustment process in which each pulse in turn is examined in chronological order commencing with the earliest pulse of the frame and the position and amplitude thereof adjusted so as to reduce the mean error during that interval in the response of the filter to the excitation which corresponds to the interval between the respective pulse and the following pulse.

6. A coder according to claim 5 in which the adjustment process is subject to the limitation that any change in pulse position shall not exceed a predetermined amount.

7. A coder according to claim 5 or 6 in which the adjustment process is repeated.

8. A coder according to claim 5 or 6 further arranged, in the, or the last, process applied to a time frame, to quantise the adjusted amplitude values, in which, in each pulse adjustment other than the first of a time frame, the excitation used to obtain the mean error to be reduced is derived using the quantised value(s) of the preceding pulses.

* * * * *